US008206328B2

(12) United States Patent
Adamson

(10) Patent No.: US 8,206,328 B2
(45) Date of Patent: Jun. 26, 2012

(54) LIPOSCULPTING DEVICE

(76) Inventor: Christopher D. Adamson, Sarasota, FL (US)

( * ) Notice: Subject to any disclaimer, the term of this patent is extended or adjusted under 35 U.S.C. 154(b) by 1185 days.

(21) Appl. No.: 11/876,385

(22) Filed: Oct. 22, 2007

(65) Prior Publication Data

US 2008/0103419 A1 May 1, 2008

Related U.S. Application Data

(60) Provisional application No. 60/862,779, filed on Oct. 25, 2006.

(51) Int. Cl.
*A61H 7/00* (2006.01)
*A61H 1/00* (2006.01)

(52) U.S. Cl. ..... 601/133; 601/80; 601/97

(58) Field of Classification Search ..... 601/81, 601/84, 93, 101, 133, 136–139, 46, 70, 72, 601/73, 80, 127, 135, 140, 97
See application file for complete search history.

(56) References Cited

U.S. PATENT DOCUMENTS 2,512,536 A * 6/1950 Zadek ..... 601/93
2,912,976 A * 11/1959 Grund ..... 601/140
3,672,355 A * 6/1972 Ogawa et al. ..... 601/73
3,750,655 A * 8/1973 Kolbel ..... 601/133
4,926,722 A 5/1990 Sorensen et al.
5,143,063 A 9/1992 Fellner
5,476,479 A * 12/1995 Green et al. ..... 606/205
5,484,390 A * 1/1996 Chiang ..... 601/133
6,190,339 B1 * 2/2001 Imazaike et al. ..... 601/133
6,355,007 B1 * 3/2002 Zuckerbrod ..... 601/72
6,391,034 B1 5/2002 Adamson et al.
6,607,498 B2 8/2003 Eshel
6,645,162 B2 11/2003 Friedman et al.
7,118,587 B2 10/2006 Dycus et al.
2004/0087943 A1 * 5/2004 Dycus et al. ..... 606/51
2005/0006434 A1 1/2005 Wales et al.
2005/0148906 A1 * 7/2005 Skover et al. ..... 601/17

* cited by examiner

*Primary Examiner* — Justine Yu
*Assistant Examiner* — Valerie L Skorupa
(74) *Attorney, Agent, or Firm* — Ronald E. Smith; Smith & Hopen, P.A.

(57) ABSTRACT

An apparatus and method for simultaneously applying a compressive and a reciprocating force to underlying adipose cells from a location external to a patient's skin to rupture or otherwise remove the adipose cells within a subcutaneous tissue region. The adipose cells are ruptured through the mechanical application of compression and shearing forces. The patient's body then re-absorbs and expels the ruptured cells. This eliminates the need for invasive liposuction and the trauma associated with invasive liposuction. Various mechanical devices may be employed to impart the compressive and shearing forces.

3 Claims, 5 Drawing Sheets

LIPOSCULPTING DEVICE

CROSS-REFERENCE TO RELATED APPLICATIONS

This application claims the benefit of U.S. provisional patent application No. 60/862,779 of the same title, filed Oct. 25, 2006 by the same inventor, which application is hereby incorporated by reference in its entirety into this nonprovisional patent application.

BACKGROUND OF THE INVENTION

1. Field of the Invention

This invention relates to an apparatus that removes adipose tissue in a noninvasive way. More particularly, it relates to a method for the removal of adipose (fat) tissue through the application of compressive and shearing forces on a target area in a patient.

2. Description of the Prior Art

Liposuction is a conventional cosmetic surgical procedure for removing fat (adipose) cells from patients to achieve a desired body shape. Liposuction usually involves an invasive surgical procedure that includes penetrating the skin, melting or shearing adipose tissue, and mechanically removing adipose tissue using a vacuum or other suctioning device.

Liposuction generally achieves the desired effect through the lysis or destruction of the underlying adipose cells. Traditional liposuction is a generally safe but possibly traumatic procedure with a risk of complications. As the cannula is moved through the tissue region, it may damage nerves and/or blood vessels, as well as fatty tissue. Complications include excessive bleeding and a risk of morbidity or mortality. Another potential problem with liposuction is lack of uniformity of the patient's final shape due to irregular removal of fatty tissue, with subsequent contour deformities.

Ultrasound techniques have been coupled to liposuction to enhance the ability to lyse adipose cells in the target region. Ultrasound assisted liposuction ("UAL") involves introducing a solid stick ultrasound transducer through an incision in the patient's skin and moving the transducer through a fatty tissue region. The transducer emits ultrasonic energy, generally at frequencies of 20-30 kHz, that heats the tissue in the region until necrosis or cavitation or both occurs, thereby rupturing adipose cells in the region. A cannula is then introduced into the tissue region to perform suction, or a hollow transducer may be used that provides suction simultaneously with the delivery of ultrasonic energy.

One shortcoming of UAL techniques is that the transducer may become quite hot during its use. This may result in damage or destruction of tissues adjacent to the target region by overheating or melting. To protect tissue outside the target region, the transducer may be introduced through the skin using an insulated sleeve, although this may require a much larger incision, perhaps about ten millimeters (10 mm) or more in length. In addition, the physician will need to exercise extreme caution and move the transducer continuously to avoid burning tissue. Treatment may also be limited to direct contact between the transducer and the adipose tissue, which may result in non-uniform destruction of fat cells in the target region.

External ultrasound liposuction has been developed as an alternative to invasive techniques. An external ultrasonic generator is used to transmit ultrasound waves through a patient's skin to underlying adipose tissue. The technique is appropriate for only certain parts of the body that are safely spaced apart from tissues and organs such as larger arteries, the heart and the ovaries. Additionally, it may be difficult to achieve the desired effect due to limitations in the process.

A vacuum roller device sold under the trademark Endermologic® purports to decrease the appearance of cellulite and to smooth fat contours. Animal studies have indicated, however, that the device does not change fat or fat cells.

Accordingly, there is a need for improved apparatus and method for destroying subcutaneous adipose cells or other tissue. However, at the time the present invention was made, it was not obvious to those of ordinary skill in this art, in view of the prior art taken as a whole, how the known procedures could be improved.

SUMMARY OF INVENTION

The long-standing but heretofore unfulfilled need for an improved adipose cell removal apparatus is now fulfilled by a new, useful, and nonobvious invention. The novel apparatus applies a compressive force to underlying adipose cells from a location external to a patient to rupture or otherwise remove cells, such as adipose cells, within a subcutaneous tissue region. The target cells, preferably adipose cells, may be ruptured through the application of shear force and then removed, for example, by natural absorption mechanisms within the body.

The novel medical device of this invention achieves human body contouring by means of external manipulation of body fat deposits. The inventor has observed that forces applied to areas of fat on the body can lead to fat necrosis with subsequent changes in the shape and volume of the fat. This has been observed in seatbelt injuries to the breasts, fall injuries to the thighs and buttocks, and other traumatic blunt force injuries. The novel device in a similar but controlled fashion creates changes in fat shape and volume through the application of force to the fat.

Without being bound to a particular theory, the mechanism of action is believed to occur in part at a cellular level. Mechanical rupture of adipocyte (fat cell) membranes is believed to release cellular contents (fat), thereby ultimately reducing or changing fat thickness and concentration to achieve body contouring. The cellular rupture occurs through a combination of pressure and motion (shearing force) and may be supplemented with application of other types of energy.

The process begins by pinching the skin and fat of the area to be contoured between two opposing surfaces to which variable amounts of compressive force can be applied. After force application, a switch is thrown to an electric motor, which creates motion of at least one of the surfaces in a direction substantially perpendicular to the direction of the compressive force. This motion creates shear forces, which potentiate adipocyte rupture. The process is repeated as necessary to achieve the desired result. The devices and methodologies can be combined with other techniques, such as thermal, ultrasonic, radiofrequency, etc., to achieve the desired effect.

An important object of the invention is to minimize trauma to the patient of the type caused by conventional liposuction.

A closely related object is to provide a method of removing adipose tissue from a patient's body in the absence of invasive surgical procedures.

Another important object is to accomplish adipose removal with a simple hand-held device that is easy to operate and inexpensive to manufacture.

These and other important objects, advantages, and features of the invention will become clear as this description proceeds.

The invention accordingly comprises the features of construction, combination of elements, and arrangement of parts that will be exemplified in the description set forth hereinafter and the scope of the invention will be indicated in the claims.

BRIEF DESCRIPTION OF THE DRAWINGS

For a fuller understanding of the invention, reference should be made to the following detailed description, taken in connection with the accompanying drawings, in which.

DETAILED DESCRIPTION OF THE PREFERRED EMBODIMENT

Figure 1:
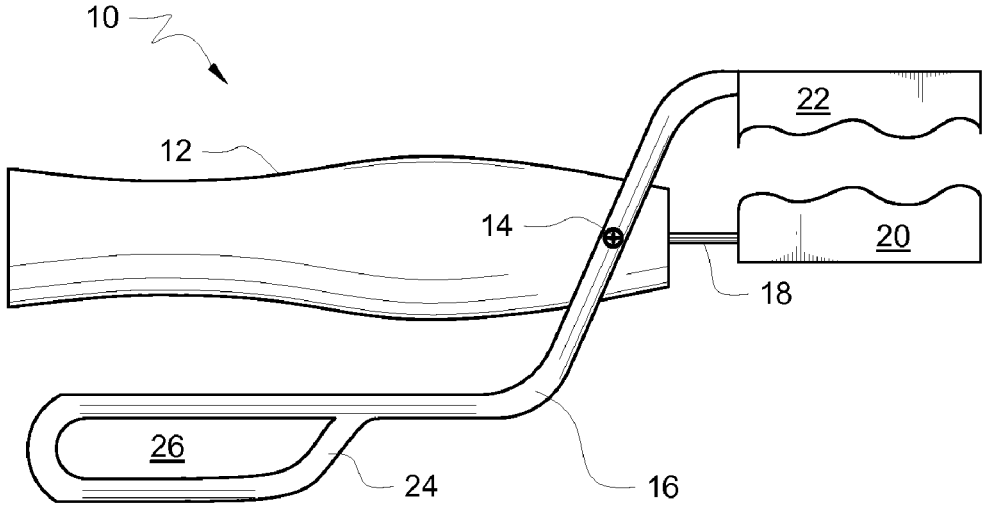
FIG. 1 is a plan view of a liposculpting device according to the present invention.

Referring now to FIG. 1, there it will be seen that an illustrative embodiment of the novel apparatus for removing subcutaneous adipose ("fat") tissue in accordance with the present invention is denoted as a whole by the reference numeral 10.

Device 10 includes hollow handle 12, pivot pin 14 near the leading end of said hollow handle, lever 16 pivotally mounted to said pivot pin, rod 18 having a proximal end disposed within the interior of hollow handle 12 and a distal end external to said hollow handle, motor driven-plate 20 mounted to the distal end of said rod, and hand-driven plate 22 secured to the distal end of lever 16.

The proximal end of lever 16 includes finger guard 24. A user grasps apparatus 10 by placing a palm in abutting relation to hollow handle 12 and extending his or her fingers through opening 26 defined by said finger guard. The patient's tissue to be treated is placed between confronting plates 20, 22 and said plates are brought towards one another by bringing the fingers toward the palm in a well-known, scissors-type action. The amount and time-duration of the compressive force is therefore controlled by the user.

In this first embodiment, the opposing surfaces of the plates are sinusoidal in configured when viewed in side elevation. The crest of one sine wave is opposed to the valley of its opposed sine wave so that plates 20 and 22 can be brought close together.

Although sinusoidal plates are preferred, this invention is not limited to opposing plates having confronting surfaces of that shape because the invention will also work with other shapes, including flat surfaces. The plates may be generally textured with a regular or irregular pattern. The confronting surface of each plate may include other geometrical configurations such as rectangles, hemispheres, waffle patterns and so on. The sinusoidal shape is preferred because it creates repeated increased force application to a particular area of fat as the crests of the two opposing sine wave patterns advantageously pass each other in a reciprocating manner as disclosed hereinafter.

Figure 2:
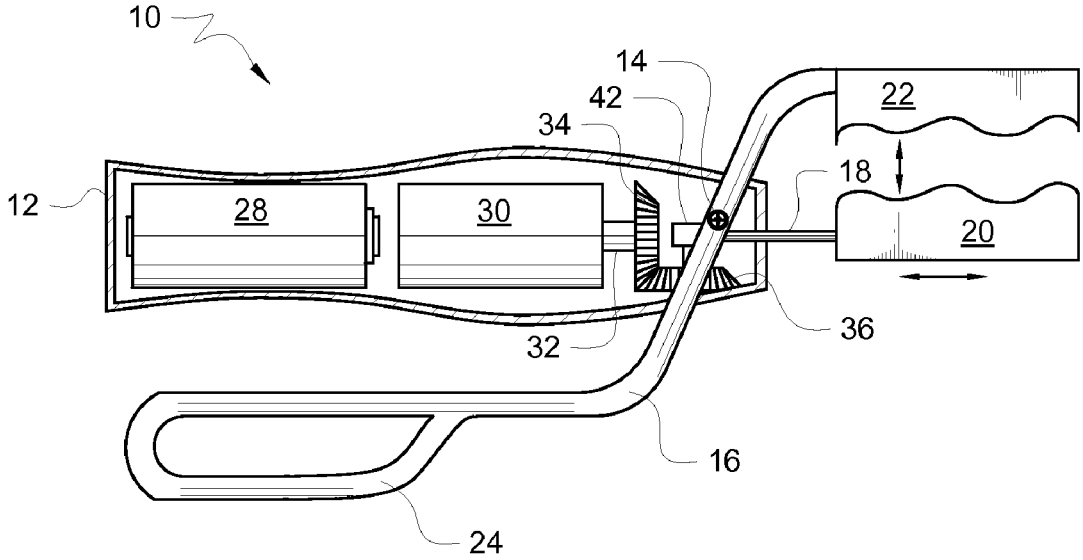
FIG. 2 is a partially sectional view of the apparatus depicted in FIG. 1.

The interior of hollow handle 12 is depicted in FIG. 2. Battery 28 provides DC power to variable speed DC motor 30 having output shaft 32. First bevel gear 34 is secured to output shaft 32 for conjoint rotation therewith. Second bevel gear 36 meshingly engages first bevel gear 34 and is mounted for rotation about its axis of rotation by an axle, not illustrated in FIG. 2.

Figure 3:
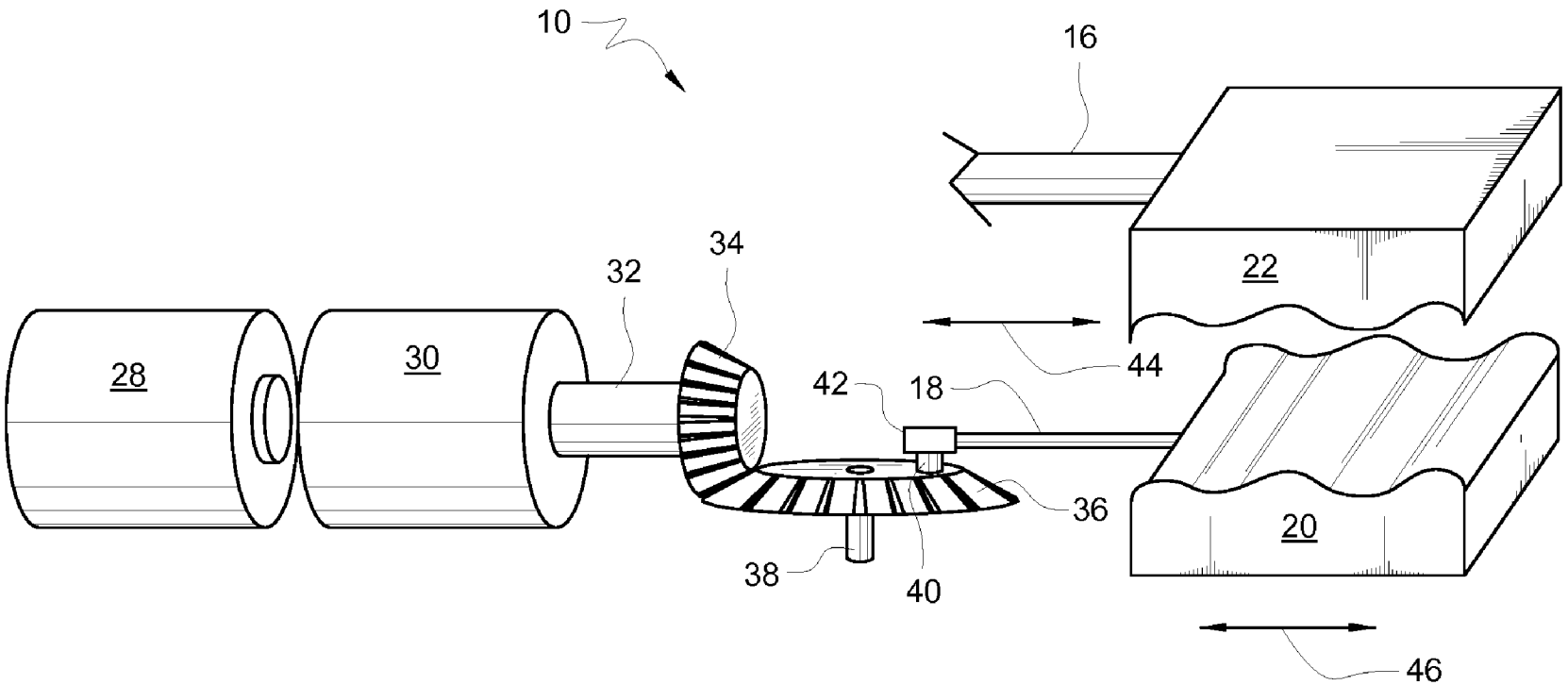
FIG. 3 is a diagrammatic perspective view of some of the parts depicted in FIG. 2.

FIG. 3 more fully depicts the drive system. The axle not depicted in FIG. 2 is depicted in FIG. 3 and is denoted 38. Pin 40 is secured to second bevel gear 36 near the periphery of said second bevel gear and collar 42 surmounts said pin. Collar 42 receives and engages the proximal end of rod 18 so that said rod reciprocates substantially in coincidence with its longitudinal axis of symmetry as indicated by double-headed arrow 44 as second bevel gear 36 rotates about axle 38. The distal end of rod 18 is secured to motor driven plate 20 so that said motor driven plate 20 also reciprocates as indicated by double-headed arrow 46. The distal end of rod 18 should be hingedly connected to motor-driven plate 20 to eliminate forces that would be transverse to the longitudinal reciprocation indicated by double-headed arrow 46.

The drive system thus reciprocates motor-driven plate 20 in a direction transverse or perpendicular to the clamping force between opposing plates 20, 22. This provides a shearing action that is applied to the skin and the underlying adipose tissue, in addition to the compressive action provided by the strength of the physician. Each revolution of second bevel gear 36 represents one shearing action. The RPMs of DC motor 30 thus determine the number of shearing actions that will occur in any particular unit of time. In a preferred embodiment, the speed of DC motor 30 is under the control of the user.

The reciprocating shearing action moves the sinusoidal surfaces of the opposing plates away from their initial matching or complementary position so that the crests and valleys are misaligned. The skin positioned between the opposing plates will thus be subjected to a shearing force of increasing strength as two opposed crests approach each other.

The motion of the surface of the opposing plates is parallel linear reciprocating, but may include other motions such as circular reciprocating, vibrating, orbital, percussive or others. The speed of the motion is variable. The energy applied to the surfaces and thus to the fat is that of direct mechanical force, but could also include ultrasonic, thermal, laser light, non-laser light, microwave, infrared, radio and others. The motion between opposing plates is relative so either or both plates may be motor-driven.

Figure 4:
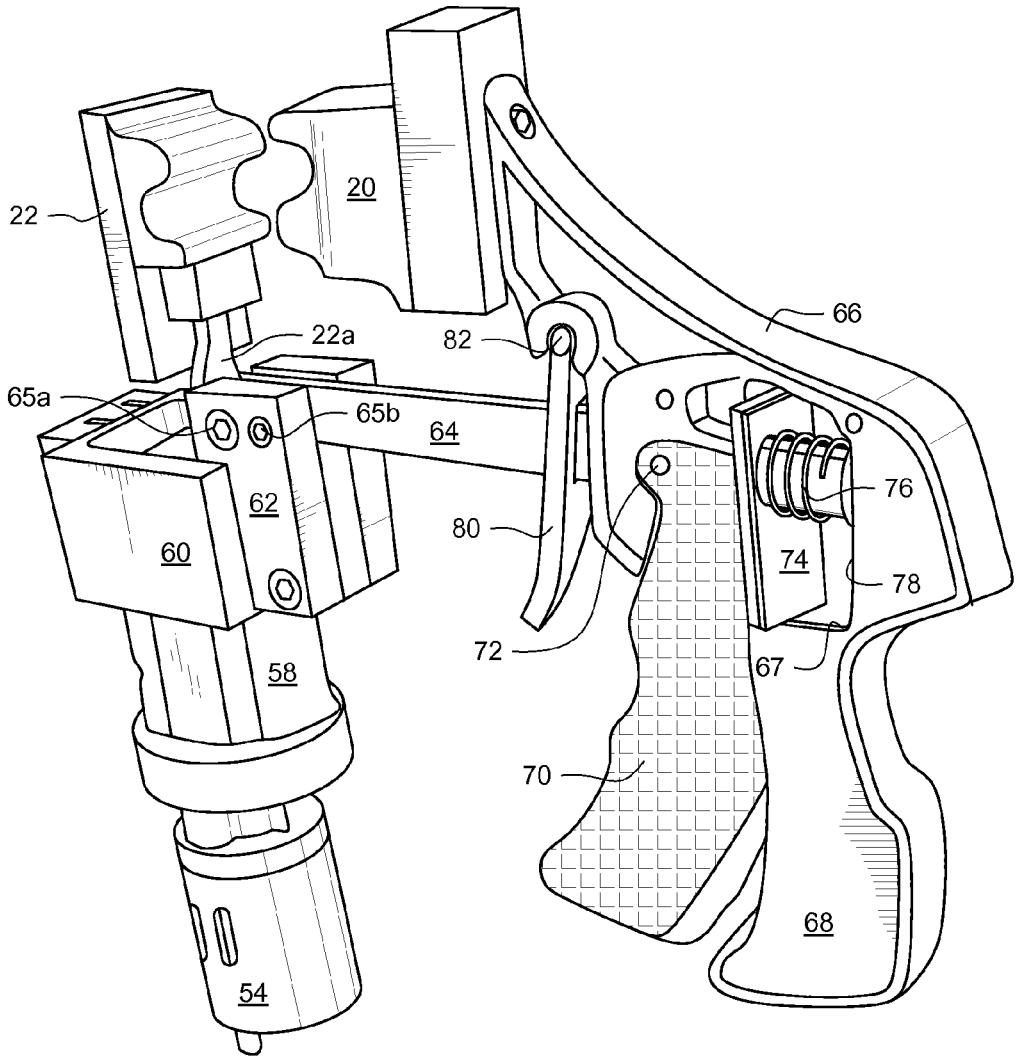
FIG. 4 is a perspective view of a second embodiment.
Figure 5:
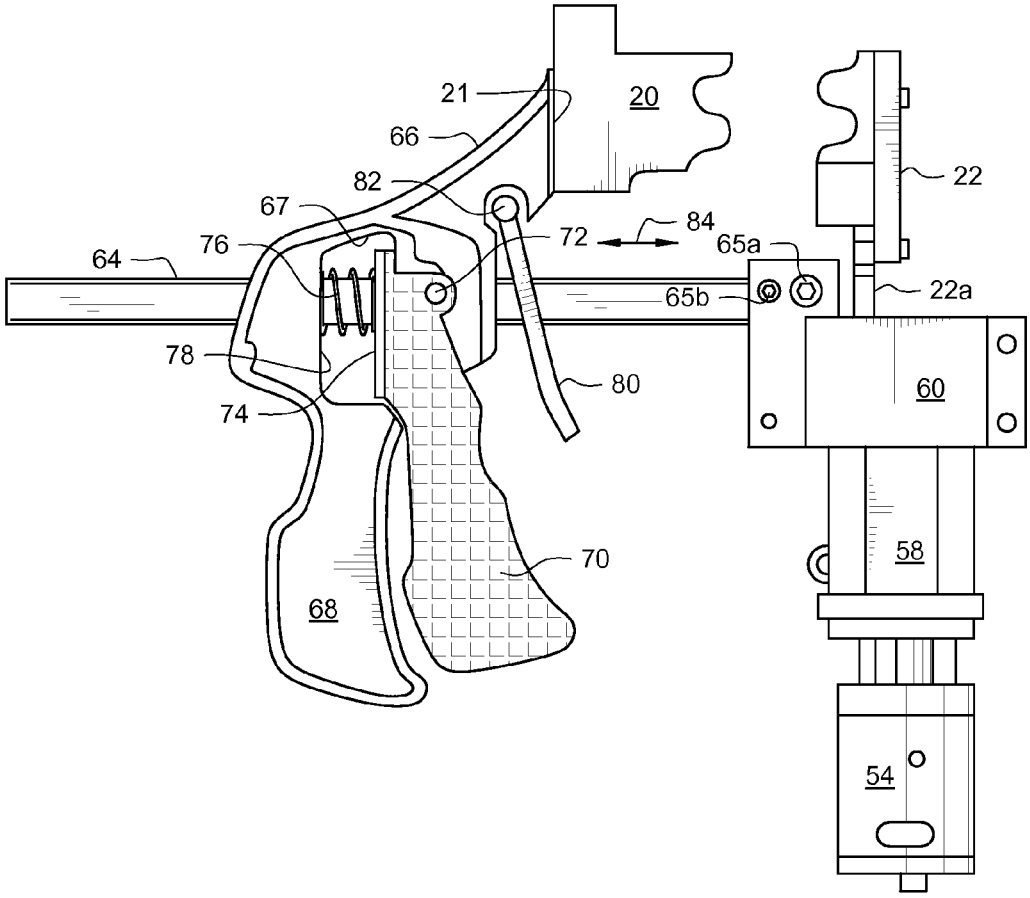
FIG. 5 is a side elevational view of said second embodiment.
Figure 6:
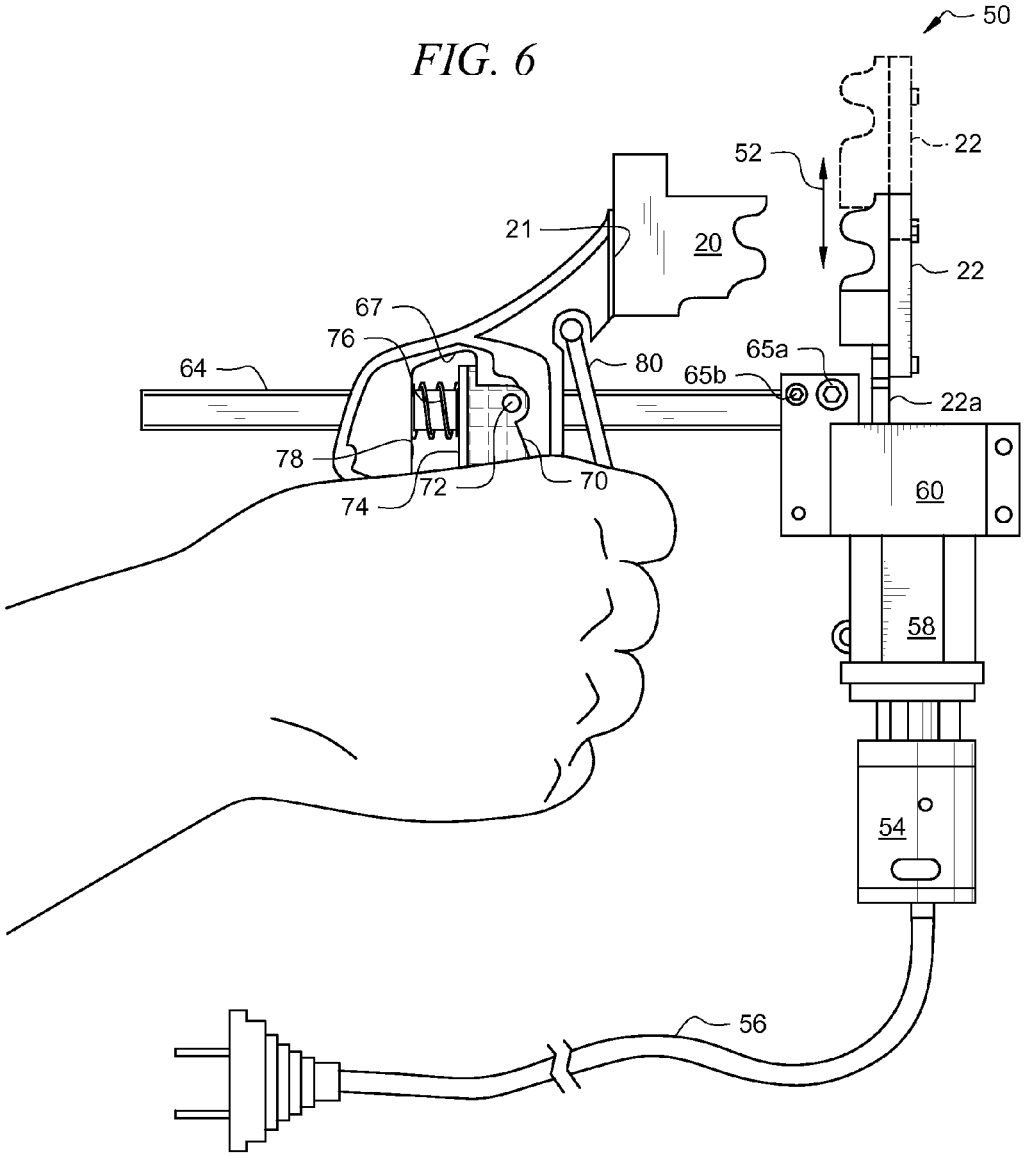
FIG. 6 is a side elevational view of said second embodiment when held by a user.

FIGS. 4-6 depict a second embodiment, denoted 50 as a whole. Tool 50 includes plates 20 and 22. Plate 22 is mounted for oscillation as indicated by double-headed directional arrow 52. Motor 54 could be battery operated but it is preferably in electrical communication with a power source through power cord 56. Gear box 58 includes a well-known gear train that converts the rotary motion of the power take-off shaft of motor 54 to the reciprocating motion of plate 22. Clamp 60 has a square-U shape to accommodate link **22*a* and is secured to gear box 58. Link 22*a* interconnects a gear in gear box 60 that rotates in a vertical plane with reciprocating plate 22**.

Clamp 60 also accommodates and engages mounting block 62 that performs the function of interconnecting the part of tool 50 having oscillating plate 22 with the part of tool 50 having stationary plate 20.

More particularly, the distal free end of elongate adjustment rod 64 is received in a slot formed in mounting block 62 as best depicted in FIG. 4 and secured in said slot by bolts **65*a*, 65*b* so that there is no rotation between said adjustment rod 64 and said mounting block 62**.

Stationary plate 20 is secured to handle 66 which is an integrally formed piece that includes a first end 68 having a pistol grip configuration. A second end of said handle forms a flat surface 21 to which is mounted said stationary plate 20. Flat surface 21 is substantially perpendicular to a longitudinal axis of elongate adjustment rod 64.

Central cavity 67 is formed in handle 66. Trigger 70 also has a pistol grip configuration. It has an upper end disposed in said cavity 67 and is pivotally mounted as at 72 to handle 66.

Flat plate 74 is secured to an upper end of trigger 70. Flat plate 74 is apertured so that adjustment rod 64 extends therethrough. Handle 66 is similarly apertured for the same reason.

Spring 76 is positioned within cavity 67 and ensleeves adjustment rod 64. A leading end of spring 76 abuts flat plate 74 and a trailing end abuts flat wall 78 of cavity 67. When in repose, spring 76 maintains trigger 70 in its position of repose as depicted in FIGS. 4 and 5. More particularly, spring 76 is adapted to bear against said flat plate 74 so that said a lower end of trigger 70 is in a pivoted position with respect to handle 66 when spring 76 is in repose.

Locking clamp 80 is pivotally mounted to handle 66 as at 82 and is also apertured to receive adjustment rod 64 therethrough. Spring 76, when in repose, also maintains locking clamp 80 in its position of repose, as depicted in FIGS. 4 and 5. When locking clamp 80 is in repose, the aperture formed in it engages adjustment rod 64 and prevents said adjustment rod from traveling along its extent, i.e., in the direction indicated by double-headed directional arrow 84, thereby preventing relative movement between opposing plates 20, 22.

When squeezed by a user, as depicted in FIG. 6, locking clamp 80 releases adjustment bar 64. Locking clamp 80 is positioned in close proximity to trigger 70 so that a user can squeeze trigger 70 at the same time that locking clamp 80 is squeezed, as best understood in connection with said FIG. 6. Squeezing trigger 70 and locking clamp 80 compresses spring 76 and enables the user to apply a compressive, pinching action to tissue, not shown, positioned between plates 20, 22. The user increases the amount of compressive force by squeezing harder on trigger 70 and reduces said compressive force by reducing the squeezing power. To release the tissue from the grip of plates 20, 22, the user releases trigger 70 and locking clamp 80 and spring 76 unloads, returning said trigger and locking clamp to their respective positions of repose as depicted in FIGS. 4 and 5.

Unlike the apparatus of FIGS. 1-3, the apparatus of FIGS. 4-6 applies the compressive force in a linear fashion across the surface of opposing plates 20, 22.

The force application may be achieved via many different types of conventional mechanisms, including various classes of levers and fulcrums such as first-class levers, double action levers (vice grips), caulking gun type mechanisms, and others. Accordingly, the invention is not limited to any particular mechanical means for creating the compressive force.

The device that provides the compressive force may be made of metal, plastics, rubbers and other non-specified materials with the various properties and friction coefficients to enable or prevent friction.

The novel device may further include a means for measuring the force applied to the surface plates. This will ensure that the applied force is sufficient to achieve the desired effect of destroying adipose cells while not harming surrounding tissue.

It will be seen that the advantages set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. A non-invasive apparatus for destroying tissue within a subcutaneous tissue region, comprising;

a hollow handle;

a lever pivotally attached to said hollow handle, said lever having a distal end and a proximal end and being pivotally secured to said hollow handle about mid-way between said distal and proximal ends;

a hand-driven first plate secured to a distal end of said lever;

a motor disposed within the hollow interior of said hollow handle;

said motor having an output shaft;

a motor-driven second plate disposed in parallel, spaced apart relation to said hand-driven first plate;

a rod having a first end disposed within the hollow interior of said hollow handle and a second end secured to said motor-driven second plate;

a gear train positioned within the hollow interior of said hollow handle;

said gear train operative to translate rotary motion of said output shaft to linear reciprocating motion of said motor-driven second plate;

said proximal end of said lever being spaced apart from and substantially parallel to said hollow handle so that bringing said hollow handle and said proximal end of said lever towards one another causes convergence of said hand-driven first plate and motor-driven second plate and applies a compressive force to epidermis tissue disposed between said first and second plates; and said compressive force being sufficient to cause said adipose tissue to lyse in said target region.

2. An apparatus for destroying tissue within a subcutaneous tissue region, comprising:

a pair of opposing plates adapted to hold epidermis tissue in sandwiched relation;

a first plate of said pair of opposing plates being mounted for reciprocating motion;

said pair of opposing plates applying a predetermined amount of pressure to said epidermis tissue, said predetermined amount of pressure being sufficient to cause adipose tissue in said epidermis tissue to lyse when said first plate is displaced in a reciprocating motion;

a motor connecting in driving relation to said first plate;

a gear train connected to a power take-off shaft of said motor for converting rotary motion of said power take-off shaft to the reciprocating motion of said first plate;

said gear train housed within a gear box that is mounted to said motor;

a clamp mounted to said gear box;

a mounting block secured to said clamp;

an elongate adjustment rod having a leading end secured to said mounting block;

a handle slideably mounted on said elongate adjustment rod;

said handle including a first end in the form of a pistol grip;

said handle including a second end in the form of a flat surface disposed perpendicular to a longitudinal axis of said elongate adjustment rod; and a second plate of said opposing plates being mounted to said flat surface.

3. The apparatus of claim 2, further comprising:

a central cavity formed in said handle;

a trigger having a pistol grip form and having an upper end received within said central cavity;

said trigger upper end being pivotally mounted to said handle;

said trigger upper end forming a flat surface, said flat surface being substantially parallel to a longitudinal axis of said elongate adjustment rod;

a locking clamp pivotally mounted to said handle;

said locking clamp being apertured to slidingly receive said elongate adjustment rod;

a bias means disposed in said central cavity, said bias means ensleeving said elongate adjustment rod and adapted to bear against said flat surface formed on said trigger upper end so that said a lower end of said trigger is in a pivoted position with respect to said handle when said bias means is in repose;

said bias means having a position of repose where it maintains said locking clamp in a position of repose so that when said locking clamp is in repose, the aperture formed in said locking clamp engages said elongate adjustment rod and prevents said elongate adjustment rod from traveling along its extent;

whereby squeezing said trigger and said locking clamp compresses said bias means and enables a user to apply a compressive, pinching action to epidermis tissue positioned between said first and second plates;

whereby said user increases the amount of compressive force by squeezing harder on said trigger and reduces said compressive force by reducing the squeezing power; and whereby when the user releases said trigger and locking clamp, said bias means unloads, returning said trigger and locking clamp to their respective positions of repose, thereby releasing the epidermis tissue from the grip of said first and second plates.

* * * * *